US005676625A

United States Patent [19]

Toth

[11] Patent Number: 5,676,625

[45] Date of Patent: Oct. 14, 1997

[54] PORTABLE EXERCISE STAND FOR BICYCLE

[76] Inventor: Mike J. Toth, 3667 W. Valley Blvd. #95, Pomona, Calif. 91768

[21] Appl. No.: 751,747

[22] Filed: Nov. 18, 1996

[51] Int. Cl.[6] ..... A63B 69/16

[52] U.S. Cl. ..... 482/61

[58] Field of Search ..... 482/57, 61; D21/194, D21/191–193, 195–199; 211/22

[56] References Cited

U.S. PATENT DOCUMENTS

| | | | |
|---|---|---|---|
| 506,495 | 10/1893 | Hart | 482/61 |
| 4,421,308 | 12/1983 | Nagy | 482/61 |
| 4,572,502 | 2/1986 | Messineo | 482/61 |
| 4,817,939 | 4/1989 | Augspurger et al. | 482/61 |
| 4,969,642 | 11/1990 | Phillips | 482/61 |

*Primary Examiner*—Stephen R. Crow

[57] ABSTRACT

A portable exercise stand for bicycles for use in association with a bicycle having two wheels and a rear axle, the rear axle including two hex nuts, the apparatus comprises an exercise stand comprising a horizontally positioned stabilizing base and two vertically positioned support bars, the stabilizing base including two parallel side stabilizing bars and a center stabilizing bar, each side stabilizing bar including at least one rubber pad to frictionally engage a floor, the center stabilizing bar being coupled to each side stabilizing bar; and each vertically positioned support bar being formed as an upper piece and a lower piece, each upper piece including a mounting bracket coupled thereto, each mounting bracket being positioned in an upwardly angled orientation, each mounting bracket including a notch formed therein, the central stabilizing bar being secured to each support bar.

4 Claims, 4 Drawing Sheets

PORTABLE EXERCISE STAND FOR BICYCLE

BACKGROUND OF THE INVENTION

1. Field of the Invention

The present invention relates to a portable exercise stand for bicycles and more particularly pertains to supporting a bicycle in a stationary position to permit exercising.

2. Description of the Prior Art

The use of bicycle stands is known in the prior art. More specifically, bicycle stands heretofore devised and utilized for the purpose of supporting bicycles are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,421,308 to Nagy a bicycle exercise stand.

U.S. Pat. No. 5,433,681 to Minoura discloses a Exercise stand for a bicycle.

U.S. Pat. No. Des. 334,038 to Case discloses a bicycle exercise stand.

U.S. Pat. No. 5,397,285 to Haan et al. discloses a centrifugal resistance device for stationary bicycle trainer.

U.S. Pat. No. 5,145,478 to Minoura discloses a bicycle exercising stand.

U.S. Pat. No. Des. 304,357 to Maes discloses a bicycle exercise stand.

U.S. Pat. No. 5,042,794 to Sun discloses a load applying device for an exercise bicycle.

U.S. Pat. No. 5,042,795 to Bursik discloses an interchangeable dual position training stand and work stand for bicyclists.

Lastly, U.S. Pat. No. 4,817,939 to Augspurger et al. discloses a cycle training device.

In this respect, the portable exercise stand for bicycles according to the present invention substantially departs from the conventional concepts and designs of the prior art, and in doing so provides an apparatus primarily developed for the purpose of supporting a bicycle in a stationary position to permit exercising.

Therefore, it can be appreciated that there exists a continuing need for a new and improved portable exercise stand for bicycles which can be used for supporting a bicycle in a stationary position to permit exercising. In this regard, the present invention substantially fulfills this need.

SUMMARY OF THE INVENTION

In view of the foregoing disadvantages inherent in the known types of bicycle stands now present in the prior art, the present invention provides an improved portable exercise stand for bicycles. As such, the general purpose of the present invention, which will be described subsequently in greater detail, is to provide a new and improved portable exercise stand for bicycles and method which has all the advantages of the prior art and none of the disadvantages.

To attain this, the present invention essentially comprises a new and improved portable exercise stand for bicycles comprising, in combination: a bicycle having a front wheel and a rear wheel, the rear wheel of the bicycle including an axle extending therethrough, the axle having two free ends, a hex nut being coupled to each free end of the axle to secure the wheel to the bicycle; an exercise stand fabricated of steel and comprising a horizontally positioned stabilizing base and two vertically positioned support bars, the stabilizing base being formed in five pieces, the stabilizing base including two inboard stabilizing bars, two outboard stabilizing bars and a center stabilizing bar, the inboard stabilizing bars being positioned parallel to each other, the outboard stabilizing bars being positioned parallel to each other, the center stabilizing bar being positioned perpendicular to the inboard stabilizing bars, each of the stabilizing bars being formed in an elongated cylindrical configuration with a hollow interior, each inboard stabilizing bar including a linear lower extent and a curved upper extent, each outboard stabilizing bar including a curved lower extent and a linear upper extent, the lower extent of each inboard stabilizing bar having a smaller diameter than that of the upper extent of each outboard stabilizing bar, the lower extent of each inboard stabilizing bar including two pins, the upper extent of each outboard stabilizing bar being positioned within the lower extent of the associated inboard stabilizing bar and secured together by the pins, the lower extent of each outboard stabilizing bar including a rubber pad to frictionally engage a floor, the center stabilizing bar being coupled to each inboard stabilizing bar; each vertically positioned support bar being formed in an elongated cylindrical configuration with a hollow interior, each support bar being formed as an upper piece, a lower piece and a middle piece, each lower piece including an indentation at its lower extent, each middle piece having a larger diameter than the upper and lower pieces and including upper and lower pairs of diametrically opposing slots extending therein, each middle piece including a spring positioned therein, the upper and lower pieces each including a pair of diametrically opposing projection members extending therefrom, the lower extent of each upper piece and the upper extent of each lower piece being positioned within the middle piece with the projection members extending through the slots, in an operative orientation, a user sitting on the bicycle positioned within the apparatus causing each spring to compress thereby allowing the upper and lower pieces to move toward each other, the slots limiting vertical movement to prevent the rear wheel of the bicycle from engaging the central stabilizing bar during use; and each upper piece including a mounting bracket coupled thereto, each mounting bracket being positioned in an upwardly angled orientation, each mounting bracket including a horizontal notch formed therein, the central stabilizing bar being positioned within the indentation at the lower extent of each support bar and secured by a bolt and associated nut, in an operative orientation a user securing the bicycle upon the support bars with the axle of the bicycle being positioned within the notches in the mounting bracket, the wheels of the bicycle being positioned a short distance above a floor, the user securing the hex nuts to the axle to stabilize the bicycle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable exercise stand for bicycles which has all of the advantages of the prior art bicycle stands and none of the disadvantages.

It is another object of the present invention to provide a new and improved portable exercise stand for bicycles which may be easily and efficiently manufactured and marketed.

It is further object of the present invention to provide a new and improved portable exercise stand for bicycles which is of durable and reliable constructions.

An even further object of the present invention is to provide a new and improved portable exercise stand for bicycles which is susceptible of a low cost of manufacture with regard to both materials and labor, and which accordingly is then susceptible of low prices of sale to the consuming public, thereby making such portable exercise stand for bicycles economically available to the buying public.

Still another object of the present invention is supporting a bicycle in a stationary position to permit exercising.

Lastly, it is an object of the present invention to provide a portable exercise stand for bicycles for use in association with a bicycle having two wheels and a rear axle, the rear axle including two hex nuts, the apparatus comprising: an exercise stand comprising a horizontally positioned stabilizing base and two vertically positioned support bars, the stabilizing base including two parallel side stabilizing bars and a center stabilizing bar, each side stabilizing bar including at least one rubber pad to frictionally engage a floor, the center stabilizing bar being coupled to each side stabilizing bar; and each vertically positioned support bar being formed in a plurality of pieces, an upper piece including a mounting bracket coupled thereto, each mounting bracket being positioned in an upwardly angled orientation, each mounting bracket including a notch formed therein, the central stabilizing bar being secured to each support bar, in an operative orientation a user securing a bicycle upon the support bars with the axle of the bicycle being positioned within the notches in the mounting bracket, the wheels of the bicycle being positioned a short distance above a floor, the user securing the hex nuts to the axle to stabilize the bicycle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
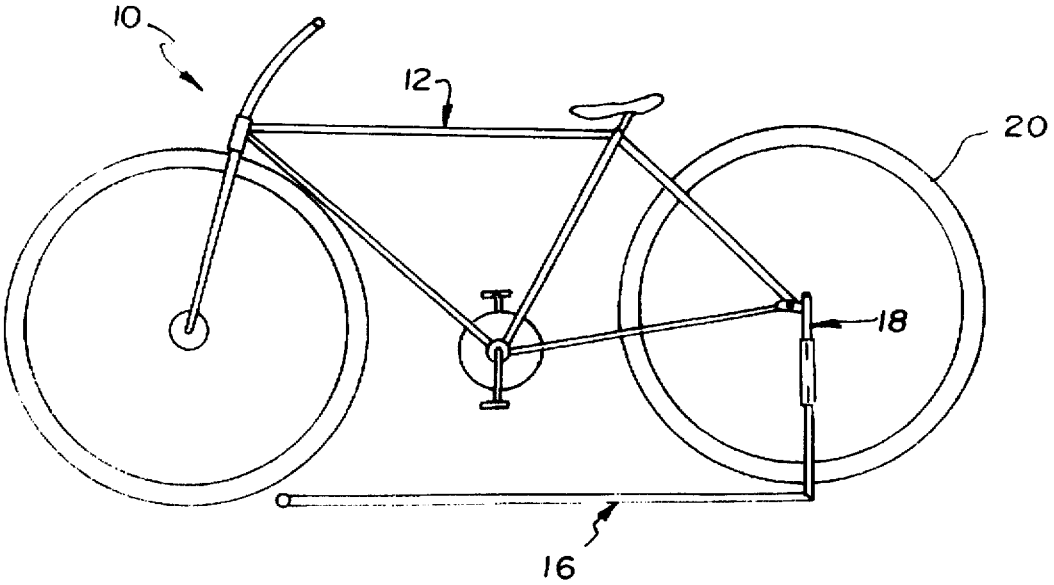
FIG. 1 is a perspective view of the preferred embodiment of the portable exercise stand for bicycles constructed in accordance with the principles of the present invention.

With reference now to the drawings, and in particular to FIG. 1 thereof, the preferred embodiment of the new and improved portable exercise stand for bicycles embodying the principles and concepts of the present invention and generally designated by the reference numeral 10 will be described.

The present invention, the portable exercise stand for bicycles 10 is comprised of a plurality of components. Such components in their broadest context include a bicycle 12, an exercise stand 14, a stabilizing base 16 and vertical support bars 18. Such components are individually configured and correlated with respect to each other so as to attain the desired objective.

More specifically, the bicycle 12 has a front wheel and a rear wheel 20, a seat, handlebars and a gear apparatus. The rear wheel of the bicycle includes an axle 22 extending through it. The axle has two free ends. A hex nut is coupled to each free end of the axle to secure the wheel to the bicycle. In alternative embodiments, a bicycle is not included with the apparatus. Rather, the stand is used with existing bicycles. In further embodiments of the apparatus, the bicycle is formed in a variety of sizes. Note FIG. 1.

Figure 2:
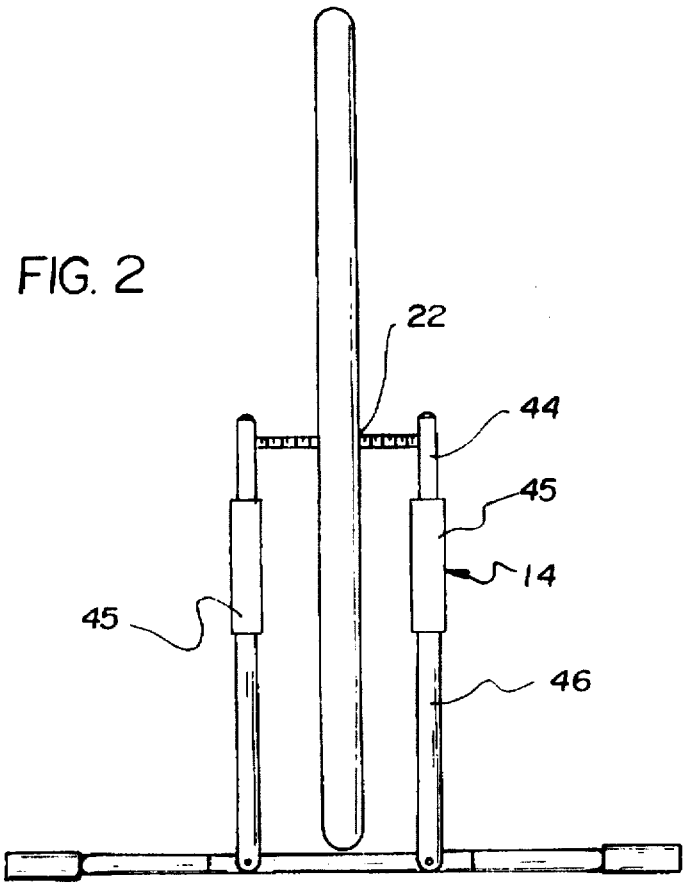
FIG. 2 is a rear perspective view illustrating the rear wheel of the bicycle secured within the stand.

The exercise stand 14 is fabricated of steel and comprises a horizontally positioned stabilizing base 16 and two vertically positioned support bars 18. The stabilizing base is formed in five pieces. The stabilizing base is generally U-shaped. The stabilizing base includes two inboard stabilizing bars 26, two outboard stabilizing bars 28 and a center stabilizing bar 30. The inboard stabilizing bars are positioned parallel to each other. The outboard stabilizing bars are also positioned parallel to each other. The center stabilizing bar 30 is positioned perpendicular to the inboard stabilizing bars 26. This orientation provides a planar base for the bicycle when resting on the stand. The wide width of the base contributes to its stability. Each of the stabilizing bars is formed in an elongated cylindrical configuration with a hollow interior. Each inboard stabilizing bar 26 includes a linear lower extent 32 and a curved upper extent 34. The upper extent is curved inwardly at a ninety degree angle with respect to the lower extent. Note FIGS. 1 and 2.

Figures 3, 4:
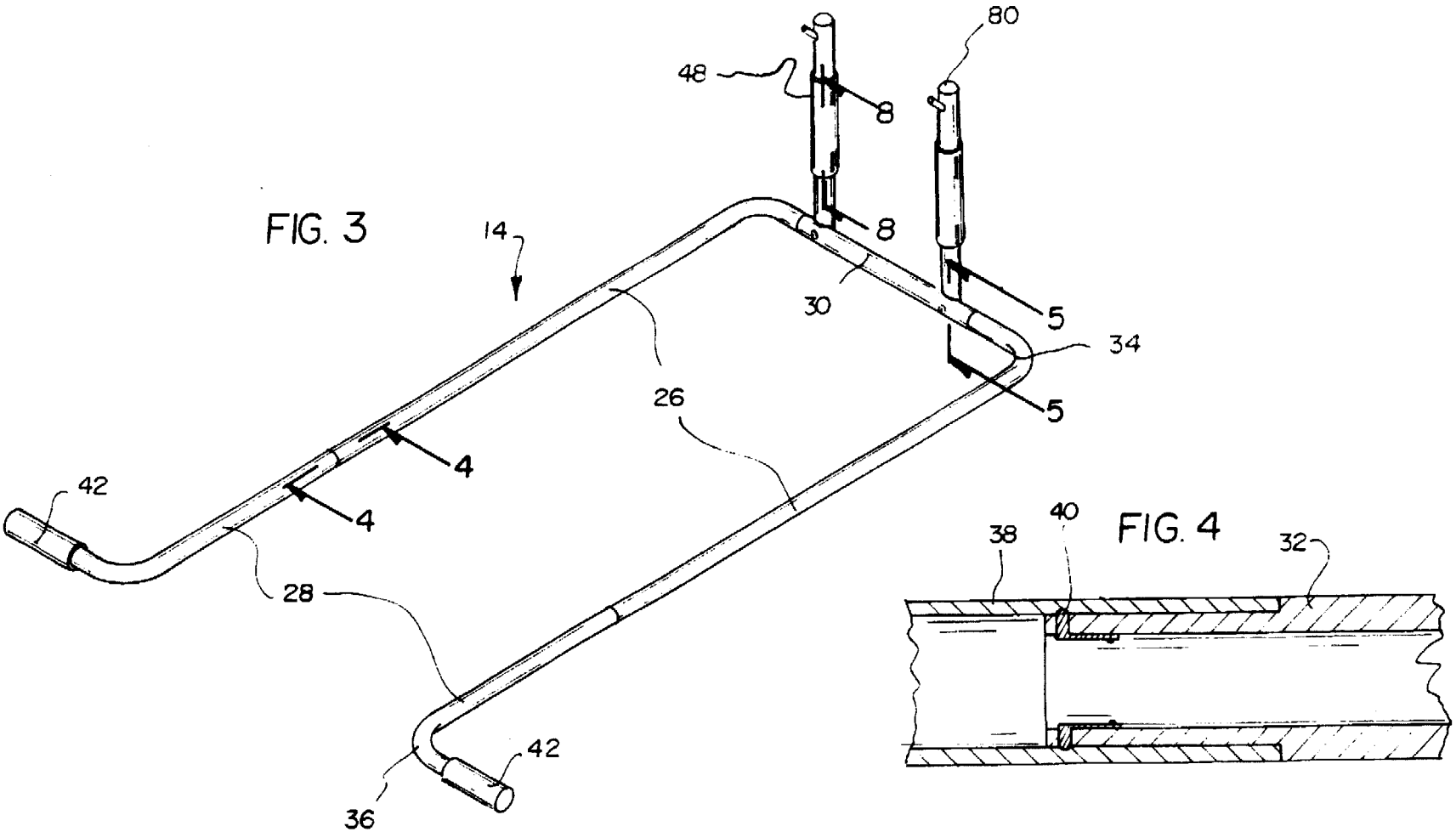
FIG. 3 is a perspective view of the apparatus illustrating the rubber pads.
FIG. 4 is a cross-sectional view of the apparatus taken along section line 4—4 of FIG. 3.
Figure 5:
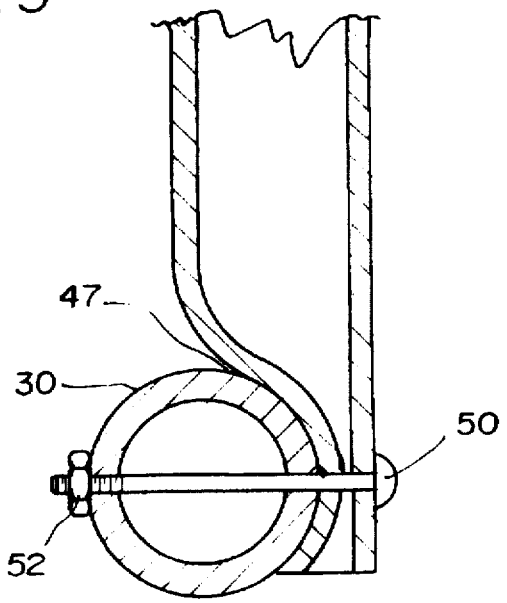
FIG. 5 is a cross sectional view of the vertical support bar taken along section line 5—5 of FIG. 3.

Each outboard stabilizing bar 28 includes a curved lower extent 36 and a linear upper extent 38. The lower extent is curved outwardly at a ninety degree angle with respect to the upper extent. The lower extent 36 of each inboard stabilizing bar has a smaller diameter than that of the upper extent 38 of each outboard stabilizing bar. The lower extent of each inboard stabilizing bar includes two pins 40. Each pin is formed with a proximal end mounted to the inboard stabilizing bar and an a distal end including a projection member. The upper extent of each outboard stabilizing bar is positioned within the lower extent of the associated inboard stabilizing bar and secured together by the pins. The lower extent of each outboard stabilizing bar includes a rubber pad 42 to frictionally engage a floor. The rubber pad is formed as an elongated cylindrical cover. The center stabilizing bar 30 is coupled to each inboard stabilizing bar. Note FIGS. 1–3.

Figure 7:
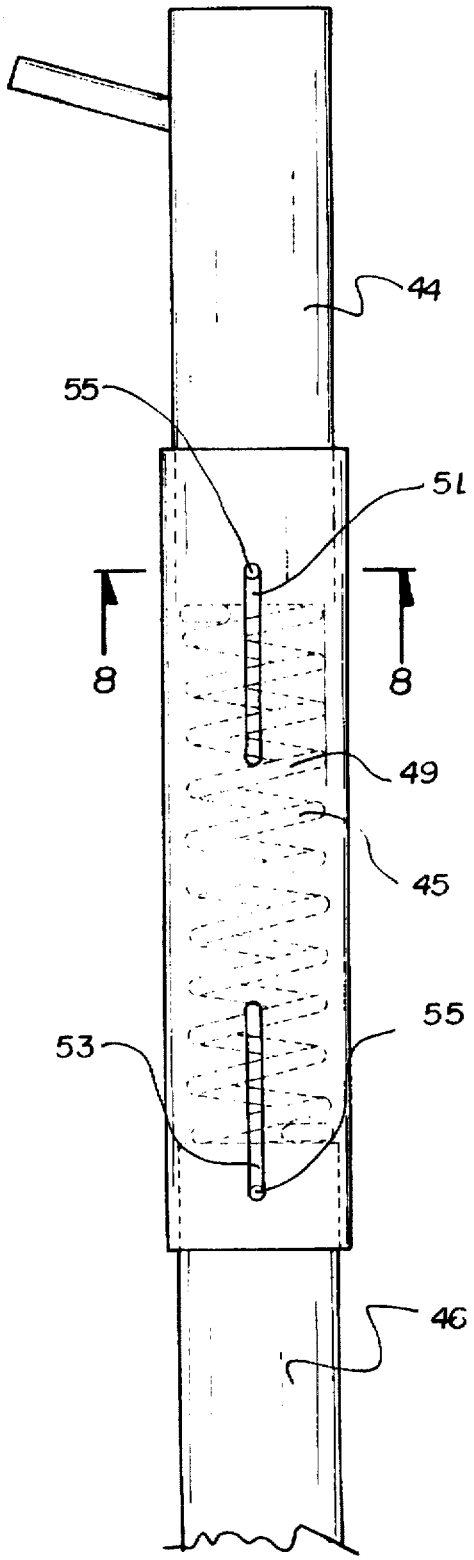
FIG. 7 is a enlarged perspective view of the middle piece and spring of the apparatus.
Figure 8:
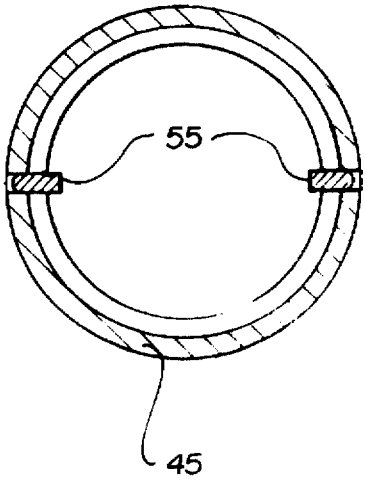
FIG. 8 is a cross sectional view of the middle piece of the vertical support bar taken along section line 8—8 of FIG. 3.

Each vertically positioned support bar 18 is formed in an elongated cylindrical configuration with a hollow interior. Each support bar 18 is formed as an upper piece 44, a lower piece 46 and a middle piece 45. Each lower piece includes an indention 47 on the inner surface of its lower extent. Each middle piece 45 has a larger diameter than the upper and lower pieces. Each middle piece includes upper 51 and lower pairs 53 of diametrically opposing slots. Each middle piece includes a spring 49 positioned within it. The upper and lower pieces each include a pair of diametrically opposing projection members 55. The lower extent of each upper piece 44 and the upper extent of each lower piece 46 are positioned within the middle piece 45 with the projection members 55 extending through the slots. Note FIGS. 2, 3 and 7.

In an operative orientation, a user sits on the bicycle positioned within the apparatus causing each spring 49 to compress, thereby allowing the upper and lower pieces to move toward each other. The slots 51, 53 function to limit vertical movement preventing the rear wheel of the bicycle from engaging the central stabilizing bar during use. This configuration provides a degree of resiliency to the apparatus, thereby allowing limited vertical movement. Each upper piece includes a mounting bracket 48 coupled to it. Each mounting bracket is positioned in an upwardly angled orientation. Each mounting bracket includes a horizontal notch 80. Note FIGS. 2, 3 and 7.

The central stabilizing bar 30 is positioned within the indentation 47 at the lower extent of each support bar and secured by a bolt 50 and associated nut 52. In an operative orientation a user secures the bicycle upon the support bars, with the axle of the bicycle positioned within the notches in the mounting bracket. The wheels of the bicycle are positioned a short distance above a floor. The user secures the hex nuts to the axle to stabilize the bicycle. The apparatus allows a user to stabilize a regular bicycle for exercise within his house. This prevents the user from having to purchase a separate exercise bike. This apparatus is especially suited for children and the physically impaired. Note FIGS. 1–5.

Figure 6:
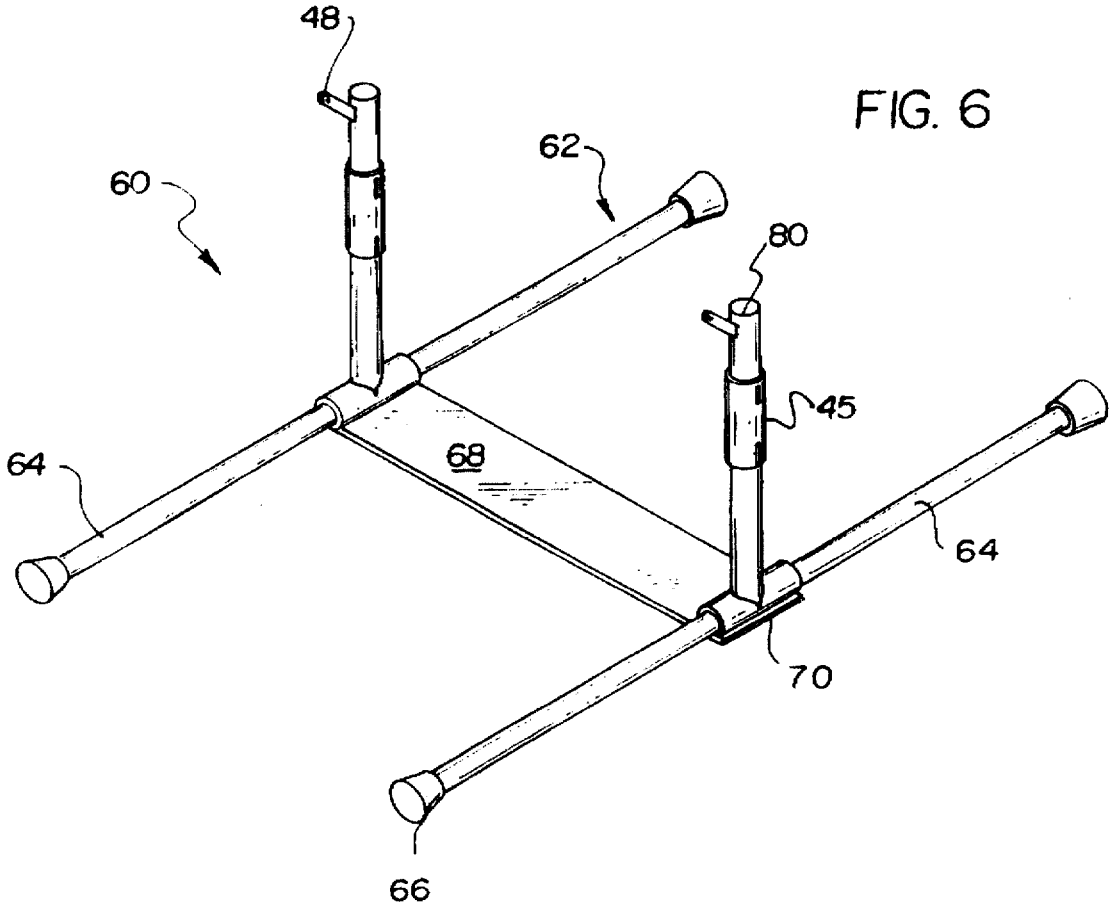
FIG. 6 is a perspective view of an alternative embodiment of the apparatus.

An alternative embodiment 60 of the apparatus is shown in FIG. 6 and includes substantially all of the components of the present invention. In such embodiment, the stabilizing base 62 is formed in three pieces. Each of the side stabilizing bars 64 has two free ends. Each of the ends including rubber pads 66. The rubber pads are formed in a generally conical configuration. The center stabilizing bar 68 is formed in a planar, rectangular orientation with a receiving tube 70 on each end. Each side stabilizing bar is positioned through a receiving tube. Each support bar 72 is secured to a receiving tube. Note FIG. 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved portable exercise stand for bicycles comprising, in combination:

a bicycle having a front wheel and a rear wheel, the rear wheel of the bicycle including an axle extending therethrough, the axle having two free ends, a hex nut being coupled to each free end of the axle to secure the wheel to the bicycle;

an exercise stand fabricated of steel and comprising a horizontally positioned stabilizing base and two vertically positioned support bars, the stabilizing base being formed in five pieces, the stabilizing base including two inboard stabilizing bars, two outboard stabilizing bars and a center stabilizing bar, the inboard stabilizing bars being positioned parallel to each other, the outboard stabilizing bars being positioned parallel to each other, the center stabilizing bar being positioned perpendicular to the inboard stabilizing bars, each of the stabilizing bars being formed in an elongated cylindrical configuration with a hollow interior, each inboard stabilizing bar including a linear lower extent and a curved upper extent, each outboard stabilizing bar including a curved lower extent and a linear upper extent, the lower extent of each inboard stabilizing bar having a smaller diameter than that of the upper extent of each outboard stabilizing bar, the lower extent of each inboard stabilizing bar including two pins, the upper extent of each outboard stabilizing bar being positioned within the lower extent of the associated inboard stabilizing bar and secured together by the pins, the lower extent of each outboard stabilizing bar including a rubber pad to frictionally engage a floor, the center stabilizing bar being coupled to each inboard stabilizing bar;

each vertically positioned support bar being formed in an elongated cylindrical configuration with a hollow interior, each support bar being formed as an upper piece, a lower piece and a middle piece, each lower piece including an indentation at its lower extent, each middle piece having a larger diameter than the upper and lower pieces and including upper and lower pairs of diametrically opposing slots extending therein, each middle piece including a spring positioned therein, the upper and lower pieces each including a pair of diametrically opposing projection members extending therefrom, the lower extent of each upper piece and the upper extent of each lower piece being positioned within the middle piece with the projection members extending through the slots, in an operative orientation, a user sitting on the bicycle positioned within the apparatus causing each spring to compress thereby allowing the upper and lower pieces to move toward each other, the slots limiting vertical movement to prevent the rear wheel of the bicycle from engaging the central stabilizing bar during use; and each upper piece including a mounting bracket coupled thereto, each mounting bracket being positioned in an upwardly angled orientation, each mounting bracket including a horizontal notch formed therein, the central stabilizing bar being positioned within the indentation at the lower extent of each support bar and secured by a bolt and associated nut, in an operative orientation a user securing the bicycle upon the support bars with the axle of the bicycle being positioned within the notches in the mounting bracket, one of the wheels of the bicycle being positioned a short distance above a floor, the user securing the hex nuts to the axle to stabilize the bicycle.

2. A portable exercise stand for bicycles for use in association with a bicycle having two wheels and a rear axle, the rear axle including two hex nuts, the apparatus comprising:

an exercise stand comprising a horizontally positioned Stabilizing base and two vertically positioned support bars, the stabilizing base including two parallel side stabilizing bars and a center stabilizing bar, the center stabilizing bar being coupled to each side stabilizing bar;

each vertically positioned support bar being formed in a plurality of pieces, an upper piece including a mounting bracket coupled thereto, each mounting bracket being positioned in an upwardly angled orientation, each mounting bracket including a notch formed therein, the central stabilizing bar being secured to each support bar, in an operative orientation a user securing a bicycle upon the support bars with the axle of the bicycle being positioned within the notches in the mounting bracket, one of the wheels of the bicycle being positioned a short distance above a floor, the user securing the hex nuts to the axle to stabilize the bicycle;

wherein the stabilizing base is formed in five pieces, the stabilizing base including two inboard stabilizing bars, two outboard stabilizing bars and a center stabilizing bar, each of the stabilizing bars being formed in an elongated cylindrical configuration with a hollow interior, each inboard stabilizing bar including a lower extent and a curved upper extent, each outboard stabilizing bar including a curved lower extent and an upper extent, the upper extent of each outboard stabilizing bar being positioned within the lower extent of the associated inboard stabilizing bar, and wherein each support bar being formed in an elongated cylindrical configuration with a hollow interior and including an indention at its lower extent, each upper piece being slidably coupled within the associated lower piece.

3. A portable exercise stand for bicycles for use in association with a bicycle having two wheels and a rear axle, the rear axle including two hex nuts, the apparatus comprising:

an exercise stand comprising a horizontally positioned stabilizing base and two vertically positioned support bars, the stabilizing base including two parallel side stabilizing bars and a center stabilizing bar, each side stabilizing bar including at least one rubber pad to frictionally engage a floor, the center stabilizing bar being coupled to each side stabilizing bar;

each vertically positioned support bar being formed in a plurality of pieces, an upper piece including a mounting bracket coupled thereto, each mounting bracket being positioned in an upwardly angled orientation, each mounting bracket including a notch formed therein, the central stabilizing bar being secured to each support bar, in an operative orientation a user securing a bicycle upon the support bars with the axle of the bicycle being positioned within the notches in the mounting bracket, one of the wheels of the bicycle being positioned a short distance above a floor, the user securing the hex nuts to the axle to stabilize the bicycle;

wherein the stabilizing base is formed in five pieces, the stabilizing base including two inboard stabilizing bars, two outboard stabilizing bars and a center stabilizing bar, each of the stabilizing bars being formed in an elongated cylindrical configuration with a hollow interior, each inboard stabilizing bar including a lower extent and a curved upper extent, each outboard stabilizing bar including a curved lower extent and an upper extent, the upper extent of each outboard stabilizing bar being positioned within the lower extent of the associated inboard stabilizing bar, and wherein each support bar being formed in an elongated cylindrical configuration with a hollow interior and including an indention at its lower extent, each upper piece being slidably coupled within the associated lower piece; and a bicycle having a front wheel and a rear wheel, the rear wheel of the bicycle including an axle extending therethrough, the axle having two free ends, a hex nut being coupled to each free end of the axle to secure the wheel to the bicycle.

4. The portable exercise stand for bicycles as set forth in claim 1 wherein each vertical support bar further includes a middle piece and a lower piece, the upper and lower pieces being coupled within the middle piece, a spring being positioned within the middle piece between the upper and lower pieces to provide resiliency to the apparatus.

* * * * *